US005410827A

United States Patent [19]

Smith

[11] Patent Number: 5,410,827

[45] Date of Patent: May 2, 1995

[54] WINDOW BADGE

[76] Inventor: Leslie P. Smith, 66 Ormond Avenue, Hampton, Middlesex TW12 2RX, England

[21] Appl. No.: 10,115

[22] Filed: Jan. 28, 1993

[30] Foreign Application Priority Data

Jan. 31, 1992 [GB] United Kingdom ..... 9202051

[51] Int. Cl.[6] ..... A44C 3/00

[52] U.S. Cl. ..... 40/1.5; 40/630; 283/98; 283/109

[58] Field of Search ..... 40/1.5, 1.6, 158.1, 40/159, 661, 5, 649, 490, 491, 611, 618, 594, 630, 638; 283/98, 99, 100, 107, 109

[56] References Cited

U.S. PATENT DOCUMENTS

| | | | |
|---|---|---|---|
| 2,364,870 | 12/1944 | Otto | 40/1.6 X |
| 3,287,839 | 11/1966 | Rotwein et al. | 283/99 |
| 3,555,712 | 1/1971 | Yargeau | 40/649 |
| 3,583,317 | 6/1971 | Gibson | 283/98 |
| 3,810,566 | 5/1974 | Adams et al. . | |
| 4,236,331 | 12/1980 | Mattson | 40/1.5 |
| 4,305,216 | 12/1981 | Skelton | 40/159 X |
| 4,330,350 | 5/1982 | Andrews | 40/1.5 X |
| 4,584,238 | 4/1986 | Gen et al. | 283/109 X |
| 4,660,309 | 4/1987 | LaRocca | 40/490 X |
| 5,074,593 | 12/1991 | Grosso | 40/661 X |

FOREIGN PATENT DOCUMENTS

| | | |
|---|---|---|
| 2115592 | 9/1983 | United Kingdom . |
| 2244255 | 11/1991 | United Kingdom . |

*Primary Examiner*—Brian K. Green
*Attorney, Agent, or Firm*—Jenner & Block

[57] ABSTRACT

A window badge (10) comprises a substrate (11) having an elongate channel (16) for slidably receiving therein an elongate strip having indicia thereon and a see-through panel (17) united with the substrate (11) and bridging the channel (16) such that the opposite ends of the channel (16) are open. The arrangement is such that the strip may be positioned in the channel (16) so that the indicia are visible through the panel (17) and are centrally located behind the panel (17).

4 Claims, 1 Drawing Sheet

WINDOW BADGE

BACKGROUND OF THE INVENTION

1. Field of the Invention

This invention relates to a window badge.

2. Description of the Related Art

A known type of window badge comprises an elongate housing formed of injection moulded plastics material having an elongate window opening in a front panel thereof and an inner longitudinal channel in register with the window opening, the channel being open at one end through a side wall of the housing so that an elongate strip having indicia thereon may be slidably received in the channel whereby the indicia are visible through the window opening. Generally, the outer surface of the front panel will have additional indicia surface printed thereon.

A disadvantage of such a window badge is that the channel is provided with an end wall against which an end portion of the slidable strip abuts and if the indicia on the strip is not positioned at a predetermined location, the indicia will not be centrally located in the window opening.

The window badge also suffers from a disadvantage in that the additional indicia are surface printed on the outer surface of front panel thereof and is subject to surface abrasion which results in the additional indicia being removed from the front panel.

SUMMARY OF THE INVENTION

According to the present invention, there is provided a window badge comprising a substrate having an elongate channel for slidably receiving therein an elongate strip having indicia thereon and a see-through panel united with the substrate and bridging the channel such that opposite ends of the channel are open whereby the strip may be positioned so that the indicia is visible through the panel and is centrally located behind the panel.

Since opposite ends of the channel are open, there is no end wall which would inhibit positioning of the strip. A window badge in accordance with the present invention therefore is not restricted by a feature which is characteristic of the known type of window badge.

Preferably, the panel extends beyond the channel and the panel and the substrate together comprise a laminate and one or other of the surfaces of the panel and the substrate which unite one with another is provided with indicia.

In this manner, the indicia is protected against surface abrasion of an outer surface of the panel.

Following is a description, by way of example only and with reference to the accompanying drawings, of one method of carrying the invention into effect.

DETAILED DESCRIPTION OF THE PREFERRED EMBODIMENT

Figure 1:
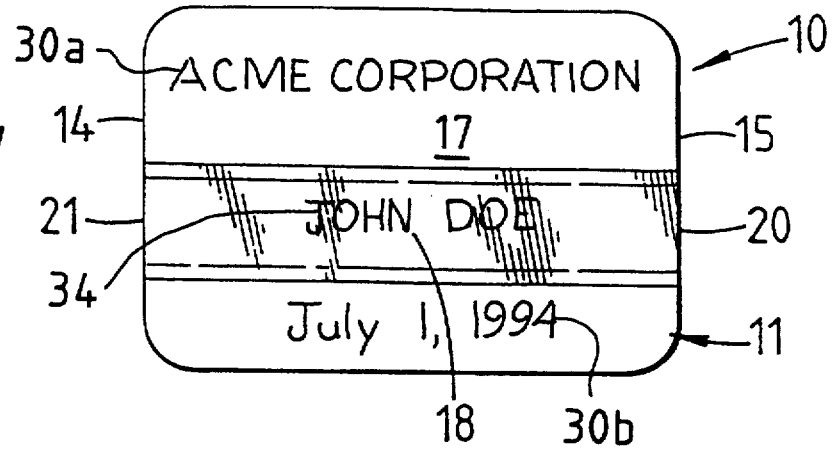
FIG. 1 is a plan view of an embodiment of a window badge in accordance with the present invention.
Figure 2:
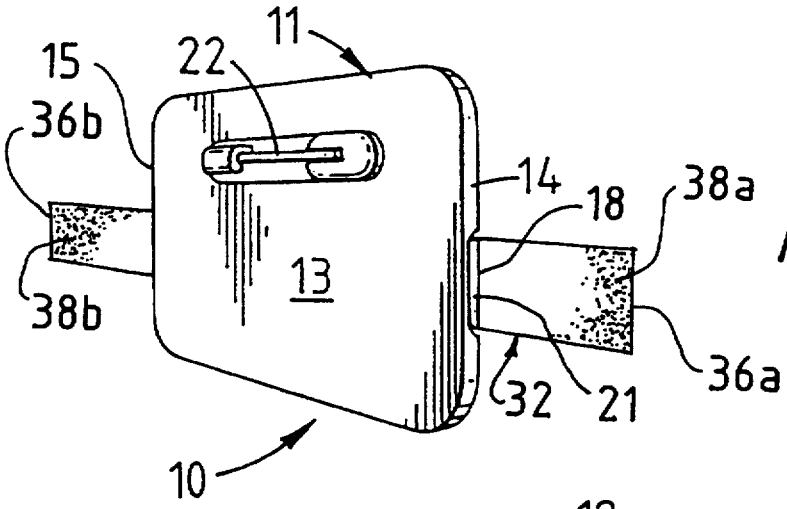
FIG. 2 is a perspective view shown from the rear of the badge shown in FIG. 1 and, FIG. 3 is a diagrammatic representation of the badge shown in FIGS. 1 and 2 indicating components of the badge.
Figure 3:
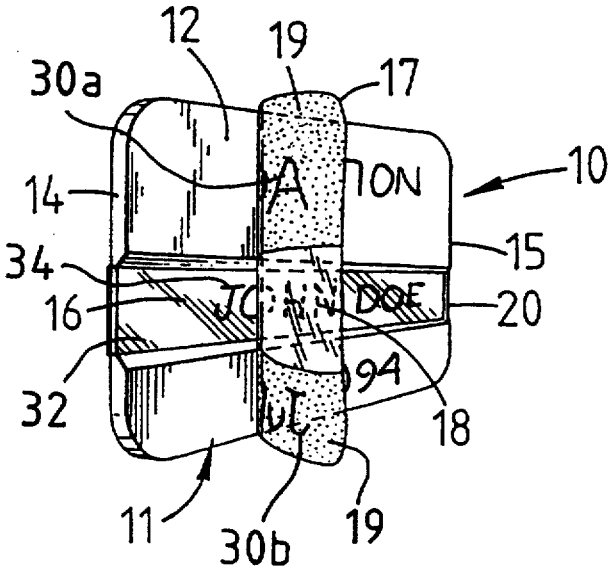

Referring now to the drawings, there is shown a window badge. 10 comprising a rectangular substrate

11 of rigid plastics material having a front surface 12, a rear surface 13 and side edges 14, 15. The front surface 12 is provided with an elongate channel 16 which extends through the side edges 14, 15 and is provided by routing the front surface 12. The front surface 12 has united therewith a panel 17 of a dimension such as to cover the whole of the front surface 12, the panel having a see-through portion 18 corresponding in area with the longitudinal and transverse dimensions of the channel 16. The panel 17 may be provided with indicia 30*a*, *b* reverse printed onto a rear surface thereof on opposite sides of the see-through portion 18 and may be provided with spaced parallel bands of pressure sensitive adhesive 19 for uniting the panel 17 with the front surface 12 of the substrate 11.

The substrate 11 and the panel 17 thus are united one with another to provide a laminate having a channel 16 therein which is open at opposite end portions thereof and provides apertures 20, 21 for slidably inserting longitudinally into the channel 16 an elongate indicia bearing strip 32. The rear surface 13 of the substrate 11 is provided with means 22 for attaching the badge 10 to a surface, such as the lapel of a jacket.

The indicia 34 provided on the strip 32 generally would be the name of an individual and the strip 32 would have a longitudinal dimension greater than the longitudinal dimension of the channel 16 and end portions 36*a*, *b* of the strip would be provided with pressure sensitive adhesive 38*a*, *b* covered by removable release tabs. After insertion of the strip 32 in the channel 16, the strip may be adjusted so that the indicia 34 are centrally located behind the panel 17. The backing tabs then are removed and the end portions 36*a*, *b* of the strip 32 are folded rearwardly and attached to the rear surface 13 of the substrate 11 by means of the adhesive 38*a*, *b*.

It will be appreciated that the indicia carried by the badge 10 may be applied to the front surface 12 of the substrate 11 instead of being applied to the rear surface of the panel 17.

I claim:

1. A window badge comprising:

a substrate having an elongate channel therein;

a see-through panel having a front surface and a rear surface, said rear surface being united with said substrate and bridging the channel such that opposite ends of the channel are open;

an elongate strip having first indicia thereon, said strip being slidable longitudinally of the channel so that the first indicia are visible through said panel and said strip being adapted to be united with said substrate so as to locate said strip relative to said substrate; and second indicia reverse printed on the rear surface of said panel;

wherein said strip is longer than the channel and opposite end portions of said strip are provided with adhesive and adapted to be folded and united with said substrate.

2. A badge as claimed in claim 1 wherein said panel includes an adhesive on the rear surface of said panel.

3. A window badge as claimed in claim 1 wherein said second indicia are reverse printed on said rear surface of said panel at a location spaced from a portion thereof which bridges the channel.

4. A window badge comprising:

a substrate having an elongate channel therein;

a see-through panel having a front surface and a rear surface, said rear surface being united with said substrate and bridging the channel such that opposite ends of the channel are open;

an elongate strip having indicia thereon, said strip being slidable longitudinally of the channel so that the indicia are visible through said panel and said strip being adapted to be united with said substrate so as to locate said strip relative to said substrate; and wherein said strip is longer than the channel and opposite end portions of said strip are provided with adhesive and adapted to be folded and united with said substrate.

* * * * *